US007298346B2

(12) United States Patent
Heyde et al.

(10) Patent No.: US 7,298,346 B2
(45) Date of Patent: Nov. 20, 2007

(54) BROADBAND MONOPOLE ANTENNA

(75) Inventors: Wolfgang Heyde, Herisau (CH); Carsten Dieckmann, St. Gallen (CH); Cenk Koparan, Urnäsch (CH); Eugen Spirig, Diepoldsau (CH)

(73) Assignee: Huber + Suhner AG, Herisau (CH)

( * ) Notice: Subject to any disclaimer, the term of this patent is extended or adjusted under 35 U.S.C. 154(b) by 38 days.

(21) Appl. No.: 11/200,513

(22) Filed: Aug. 9, 2005

(65) Prior Publication Data

US 2006/0055616 A1 Mar. 16, 2006

Related U.S. Application Data

(63) Continuation of application No. PCT/CH2003/000844, filed on Dec. 23, 2003.

(30) Foreign Application Priority Data

Feb. 14, 2003 (CH) ..... 0228/03

(51) Int. Cl.
*H01Q 9/30* (2006.01)

(52) U.S. Cl. ..... 343/828; 343/825; 343/830

(58) Field of Classification Search ..... 343/830, 343/829, 702, 846, 825, 828
See application file for complete search history.

(56) References Cited

U.S. PATENT DOCUMENTS 5,872,546 A * 2/1999 Ihara et al. ..... 343/795
6,437,756 B1 * 8/2002 Schantz ..... 343/866
6,842,141 B2 * 1/2005 Suh et al. ..... 343/700 MS

OTHER PUBLICATIONS

Anob, P.V., et al. "*Wideband Orthogonal Square Monopole Antennas With Semi-Circular Base*" XP-001072280, 2001, pp. 294-297.
Agrawall, Narayan Prasad, et al. "*Wide-Band Planar Monopole Antennas*", IEEE Transactions on Antennas and Propagation, vol. 46, No. 2, Feb. 1998, pp. 294-295.
Landstorfer, Von Friedrich, et al. "*Nachrichtentechnische Zeitschrift*", Dec. 1972, pp. 537-541.
Wunsch, David A. et al., "A Closed-Form Expression for the Driving-Point Impedance of the Small Inverted L Antenna," IEEE Transactions on Antennas and Propagation, vol. 44, No. 2, Feb. 1996, pp. 236-242.
Rashed, J. et al., "A New Class of Resonant Antennas," IEEE Transactions on Antennas and Propagation, vol. AP-39, No. 9, Sep. 1991, pp. 1428-1430.
Agrawall, Narayan Prasad, et al. "*New Wideband Monopole Antennas*", 1997, pp. 248-251.
Anob, P.V., et al., "*Wideband Orthogonal Square Monopole Antennas With Semi-Circular Base*" XP-001072280,, 2001, pp. 294-297.
Agrawall, Narayan Prasad, et al. "*Wide-Band Planar Monopole Antennas*", IEEE Transactions on Antennas and Propagation, vol. 46, No. 2, Feb. 1998, pp. 294-295.
Landstorfer, Von Friedrich, et al. "*Nachrichtentechnische Zeitschrift*", Dec. 1972, pp. 537-541.

* cited by examiner

*Primary Examiner*—Tho Phan
(74) *Attorney, Agent, or Firm*—Burr & Brown

(57) ABSTRACT

A wideband monopole antenna including an emitter which is embodied in the form of a disc and vertically arranged at a predetermined spacing above an electrically conductive base plane. The disc-shaped emitter includes a modified section initially having a circular or elliptical disc form, with the modified section being limited by a border outline deviating from the circular or elliptical form.

11 Claims, 7 Drawing Sheets

BROADBAND MONOPOLE ANTENNA

CROSS REFERENCE TO RELATED APPLICATIONS

This application is a continuation of International Application No. PCT/CH2003/000844, having an international filing date of Dec. 23, 2003, which designated the United States, the entirety of which is incorporated herein by reference.

This application also claims the benefit of Swiss Patent Application No. 228/03, filed Feb. 14, 2003, the entirety of which is incorporated herein by reference.

FIELD OF THE INVENTION

The present invention relates to the field of broadband wireless communications, and in particular to a broadband monopole antenna that includes a disk-shaped antenna element having a modified section bounded by an edge contour that is other than circular or elliptical in shape.

BACKGROUND OF THE INVENTION

The applications of wireless communication techniques have increased substantially in the last two decades. This has led to both speech and data services being transmitted in widely differing frequency bands. Essentially, the 400, 800, 900, 1800 and 1900 MHz bands are available worldwide for mobile speech transmission. With the introduction of the UMTS Standard (Universal Mobile Telecommunication System), the frequency range has been extended to 2170 MHz. As an alternative to landline telephony—keyword WLL (Wireless Local Loop)—the frequency range between 3400 and 3600 MHz has been released in various European countries in recent years. Where the aim is to transmit high data rates, this can now be done without the use of wires using the WLAN frequencies (Wireless Local Area Network). The frequencies released for these applications are in the 2.4 and 5.5 GHz range.

In order to make it possible to supply areas within buildings, such as commercial premises, airports, train stations, underground garages and hotels, with all of these services efficiently, an entire forest of antennas would be necessary if the individual antennas were to operate exclusively in the relevant frequency bands. There is, therefore, a demand to minimize this forest of antennas as far as possible. The aim is accordingly to have an antenna which covers, as much as possible, the frequency range from 800 to 6000 MHz and is suitable for use within buildings (so-called "in-house areas").

One form of broadband antenna that is particularly suitable by virtue of its simplicity is the monopole antenna. The history of these broadband monopole antennas has been described, inter alia, in the article by Xu Liang et al., "Low-Profile Broadband Omnidirectional Monopole Antenna", Microwave and Optical Techn. Lett., Vol. 25, No. 2, April 2000, p. 135-138, and in the article by N. P. Agrawall et al., "Wide-Band Planar Monopole Antennas", IEEE Trans. on Antennas and Propagation, Vol. 46, No. 2, February 1998, p. 294-295. The first article describes rotationally symmetrical monopoles, while the second article covers the characteristics of planar monopoles in the form of a round or elliptical disk. The planar structure in this case has the advantage that it can be produced considerably more easily, and thus at a lower cost.

Such broadband monopole antennas are known. For example, U.S. Pat. No. 4,370,660 discloses a broadband monopole antenna with a planar elliptical disk with the aim of achieving a standing wave ratio (SWR) of less than 1.5 in a frequency range between about 800 MHz and 4.5 GHz.

GB Publication No. 2,236,625 discloses a broadband monopole antenna whose antenna element is in the form of a micro-stripline with two rectangular conductor surfaces on opposite faces of a dielectric substrate. This antenna is intended to make it possible to achieve a bandwidth ratio of better than 1:5 (frequency range between 700 MHz and 4 GHz) for a voltage standing wave ratio (VSWR) of less than 2.5:1.

U.S. Statutory Invention Registration No. H2016 (filed Mar. 5, 1986 and published Apr. 2, 2002) discloses a broadband monopole antenna in the form of a "mono-blade antenna" in which a single antenna element in the form of a blade is arranged above a base surface. An antenna such as this is intended to allow operating frequencies up to 8 GHz with a VSWR of less than 1.2:1.

The Agrawall article mentioned above discloses that the antennas described therein can achieve a VSWR of less than 1.5 at a maximum of 3.75-11.5 GHz (see FIG. 1 of the Agrawall article). This corresponds to a bandwidth ratio of only 1:3.1. As described above, however, it is desirable to provide an antenna for the frequency range from 800 to 6000 MHz, which corresponds to a bandwidth ratio of 1:7.5. In this case a VSWR (Voltage Standing Wave Ratio) of <1.5 should be achieved in all cases for this bandwidth ratio.

SUMMARY OF THE INVENTION

One object of the invention is to provide a broadband monopole antenna which (a) can be used in a frequency range from at least 800 to 6000 MHz, (b) has a bandwidth ratio of 1:7.5, (c) can always achieve a VSWR of <1.5 for this bandwidth ratio, and (d) which can be used in particular in in-house areas owing to its simple and compact design.

One embodiment of the present invention that achieves this object is a broadband antenna that includes an antenna element in the form of a disk as a monopole above an electrically conductive, planar base surface. The general shape of the antenna element is based on the shape of a circular disk or elliptical disk, but has a modified section which is bounded by an edge contour whose shape is not circular or elliptical. While the fundamental circular or elliptical shape ensures a low VSWR in particular up to frequencies at the upper end of the frequency range, the non-circular and non-elliptical shape considerably improves the response at frequencies at the lower end of the frequency range.

In another embodiment of the invention, the modified section has a rectangular edge contour. In this case, it is possible for the modified section to be bounded exclusively by a rectangular edge contour, and for the modified section to have further edge contours which are not circular or elliptical in addition to a rectangular edge contour, in which case the further edge contours which are not circular or elliptical may be in the form of round lobes, for example.

In yet another embodiment of the invention, the modified section has a polygonal edge contour with corners which are not rectangular, with the polygonal edge contour having, in particular, acute-angle corners and obtuse-angle corners.

It is preferred that the modified section is located above a separating plane, which runs parallel to the base surface and separates the modified section from the rest of the antenna element.

It is also preferred that the antenna element is in the form of a disk having mirror-image symmetry with respect to a center plane which is vertical with respect to the base surface.

A feed point for feeding in the antenna signal can be provided on the antenna element on the center plane on the edge facing the base surface. The feed can be provided via the central conductor of a coaxial connector, with the central conductor being passed through the base surface to the feed point from the coaxial connector, which is arranged underneath the base surface. However, it is also feasible to provide the feed via a feed network which is arranged on one side of the base surface, in which case the feed network may have filter structures and/or active elements.

The broadband monopole antenna according to the invention preferably covers a bandwidth ratio of at least 1:7.5 with a VSWR of less than 1.5. In particular, the broadband monopole antenna covers a frequency range from 800 to 6000 MHz with a VSWR of less than 1.5.

In still another embodiment of the invention, the antenna element is spaced above the base surface by a distance (h) in the range of 0.3 to 1 mm. The most preferred spacing is 0.5 mm.

When the antenna element has the basic shape of a circular disk, it is preferred that the radius of the disk is between 30 and 70 mm, with the most preferred radius being about 50 mm. When the antenna element has the basic shape of a vertical or horizontal elliptical disk, it is preferred that the ratio of the major axis to the minor axis is between 1.1 and 1.3.

In order to avoid the lower operating frequency from being shifted in the direction of higher frequencies, it is advantageous for the base surface to have a minimum diameter which corresponds to the wavelength of the lowest operating frequency. The base surface is preferably circular and has a diameter of about 200 mm.

It is also advantageous for the base surface and the antenna element to be composed of a highly electrically conductive material, preferably aluminum or brass, and for the thickness of the base surface and of the antenna element to be considerably larger than the penetration depth of the skin effect at the operating frequencies of the antenna.

In order to keep the physical height of the antenna according to the invention as small as possible, it is advantageous for the antenna element to be curved such that the vertical length of the antenna element is less than what it would be if left in the uncurved state. Preferably, the curved antenna element has a vertical length in the range between 0.2 and 0.35 $\lambda$, where $\lambda$ denotes the wavelength of the lowest operating frequency of the antenna.

It is also advantageous for the curvature of the antenna element to start above a predetermined distance from the lower edge of the antenna element, and for the distance to be in the range between 0.02 and 0.06 $\lambda$, where $\lambda$ denotes the wavelength of the lowest operating frequency of the antenna.

It is also advantageous for the curvature of the antenna element to have an antenna with a depth which is in the range between 0.07 and 0.13 $\lambda$, where $\lambda$ denotes the wavelength of the lowest operating frequency of the antenna.

In another embodiment of the invention, openings or apertures may be arranged in the antenna element in order to improve the antenna matching. These openings may be round, elliptical, square or of any desired polygonal form. The arrangement of these openings or apertures can be selected to allow improved antenna matching in specific frequency ranges of the operating band.

It is also possible for beads to be formed in the surfaces of the antenna element in order to increase the mechanical robustness of the antenna element.

BRIEF DESCRIPTION OF THE DRAWINGS

The invention will be explained in more detail in the following text with reference to exemplary embodiments and in conjunction with the drawings, in which.

DETAILED DESCRIPTION OF THE INVENTION

If an antenna for the frequency range from 800 to 6000 MHz is considered by way of example, then this frequency range corresponds to a bandwidth ratio of 1:7.5. The aim of the present invention was to achieve a VSWR of <1.5 in all cases for this bandwidth ratio. The Agrawall article discussed earlier discloses an antenna that purportedly achieved a VSWR of <1.5 from 3.75 to 11.5 GHz as a maximum using circular (CDM) as well as horizontal (EDM1A) and vertical (EDM1B) elliptical antenna elements (see FIG. 1 of the Agrawall article). This corresponds to a bandwidth ratio of only 1:3.1. The present invention is now based on the discovery that a modification in particular to the upper half of such an antenna results in a considerable improvement in the lower frequency range. Examples of the possible forms of the modification to the antenna will be described below with reference to FIGS. 1 to 4.

Figure 1:
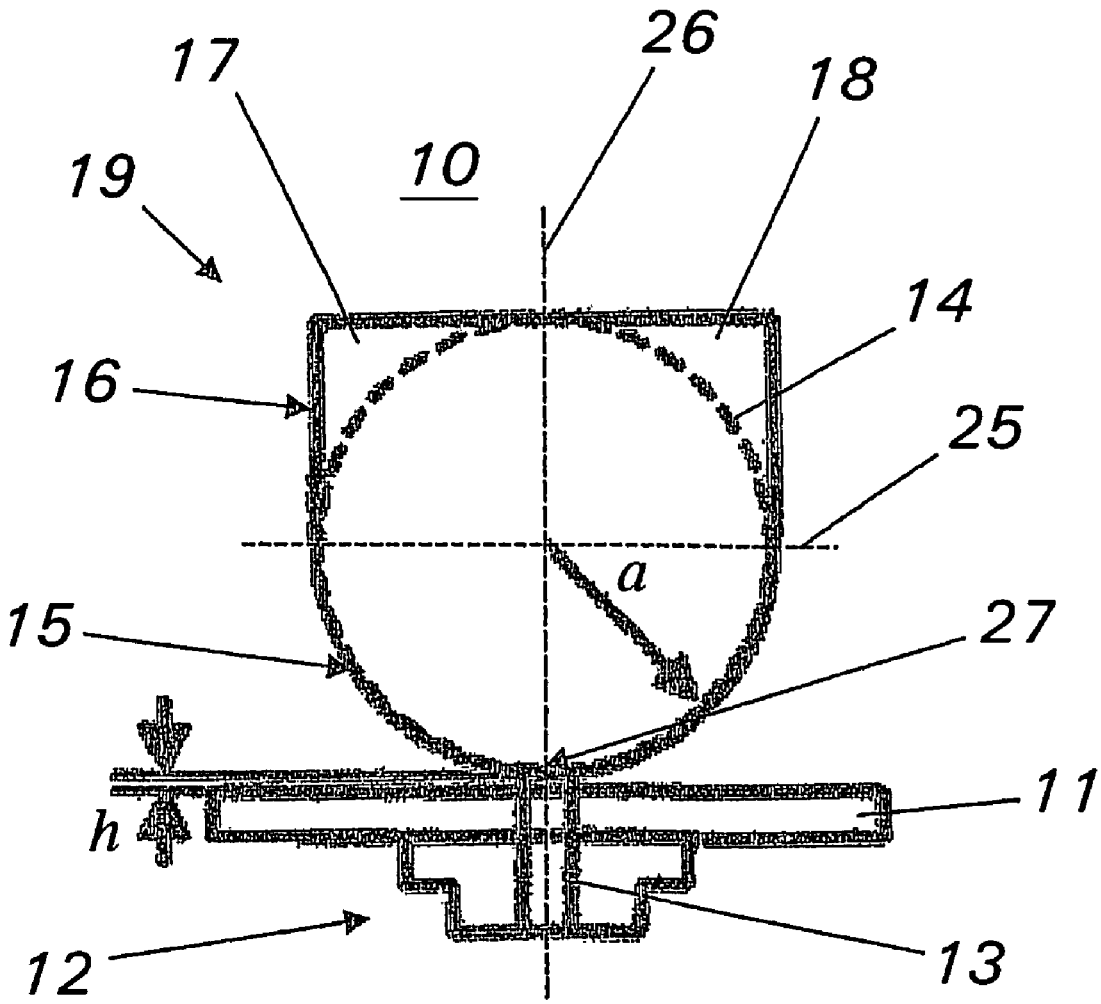
FIG. 1 is a front view of a first embodiment of an antenna according to the invention, in which the antenna element has a non-circular rectangular contour above a separating plane.

FIG. 1 is a front view of a first embodiment of a broadband monopole antenna according to the invention. The broadband monopole antenna 10 shown in FIG. 1 has a planar, electrically conductive base surface 11. An antenna element 19, which is in the form of a disk, is mounted vertically on the base surface 11 and is spaced above the base surface 11 by a distance (h). The shape of the antenna element 10 in the form of a disk is based on a circular disk 14 with a radius a, which is shown by the dashed line in FIG. 1. The antenna element 19 is circular below a separating plane 25 that is located parallel to the base surface 11, and forms a circular section 15. Above the separating plane 25, the edge contour of the antenna element 19 is not circular, and encloses a modified section 16. In the embodiment shown in FIG. 1, the modified edge contour above the separating plane 25 forms a rectangle with two right-angle corners 17 and 18. The antenna element 19 in the form of a disk including the right-angle modified section 16 is mirror-image symmetrical with respect to a center plane 26 at right angles to the base surface 11.

The feed point 27 for the antenna element 19 is provided at the intersection of the center plane 26 with the (lower) edge of the circular section 15. The feed is provided via the central conductor 13 of a coaxial connector 12. For this purpose, the central conductor 13 is passed through the base surface 11 to the feed point from the coaxial connector 12, which is arranged underneath the base surface 11.

Figure 2:
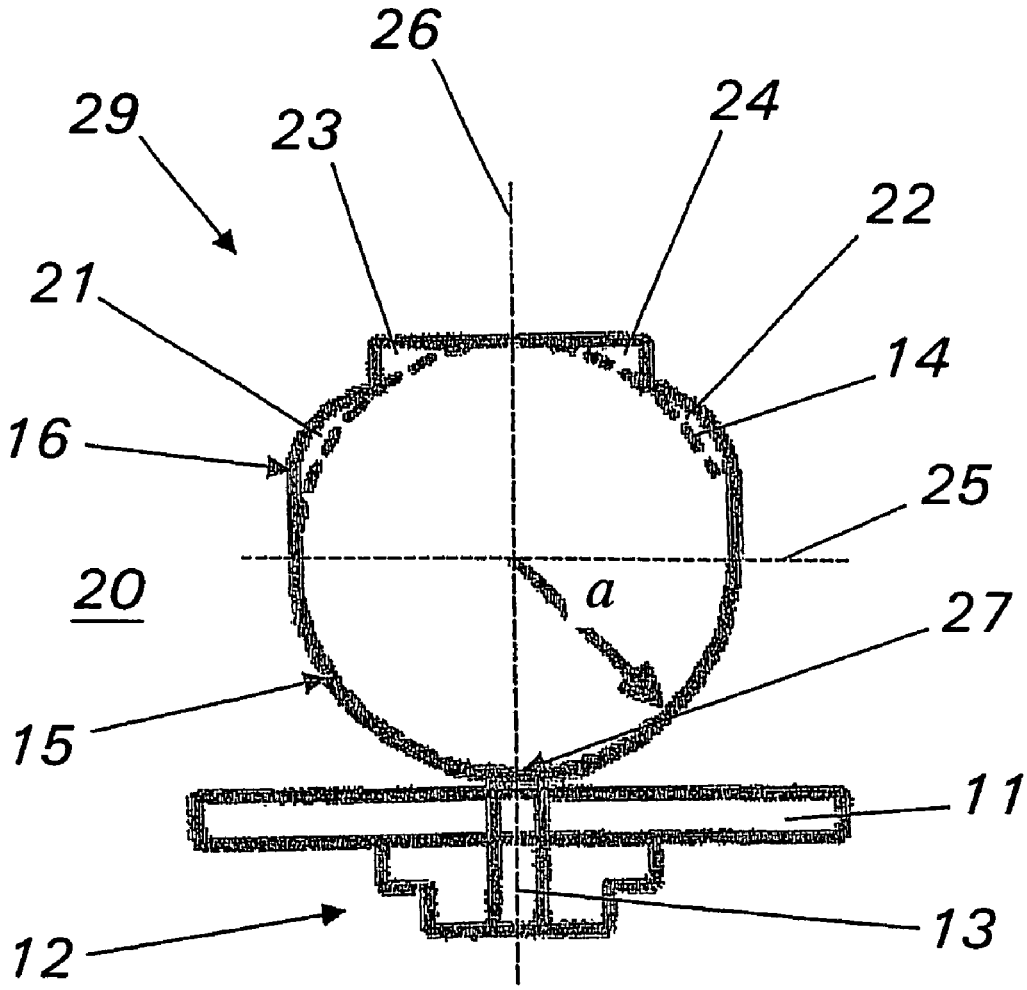
FIG. 2 is a front view of a second embodiment of an antenna according to the invention, in which the antenna element has a non-circular contour with a rectangular section and additional lobes above a separating plane.

In an illustration analogous to that shown in FIG. 1, FIG. 2 shows a second embodiment of an antenna according to the invention. The broadband monopole antenna 29 shown in FIG. 2 is largely analogous to the broadband monopole antenna 19 shown in FIG. 1, with the difference being that the modified section 16 of the circular disk 14 has a different edge contour. In this case, the edge contour has a rectangular section with the right-angled corners 23 and 24 as well as two round lobes 21, 22, which are adjacent to the two sides of the rectangular section.

Figure 3:
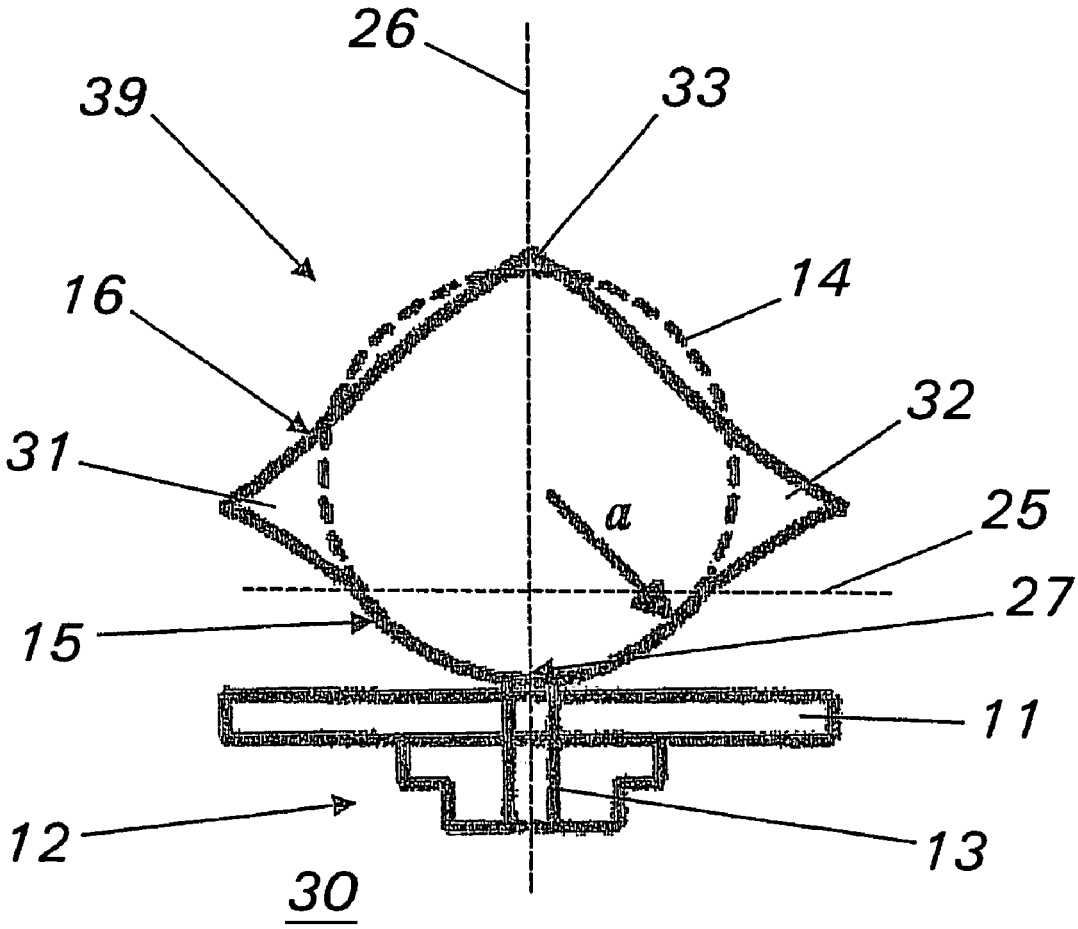
FIG. 3 is a front view of a third embodiment of an antenna according to the invention, in which the antenna element has a non-circular contour with a number of acute-angle and obtuse-angle corners above a separating plane.

In an illustration analogous to that shown in FIG. 1, FIG. 3 shows a third embodiment of an antenna according to the invention. The broadband monopole antenna 39 in FIG. 3 differs more significantly from the broadband monopole antenna 19 shown in FIG. 1. There is only one comparatively narrow circular section 15 underneath the separating plane 25 in this case, while the modified section 16 above the separating plane 25 differs considerably from the shape of the circular disk 14. These differences are caused by two opposite acute-angled corners 31 and 32 as well as an obtuse-angled corner 33 which is located on the center plane, so that the modified contour is rather diamond-shaped.

Figure 4:
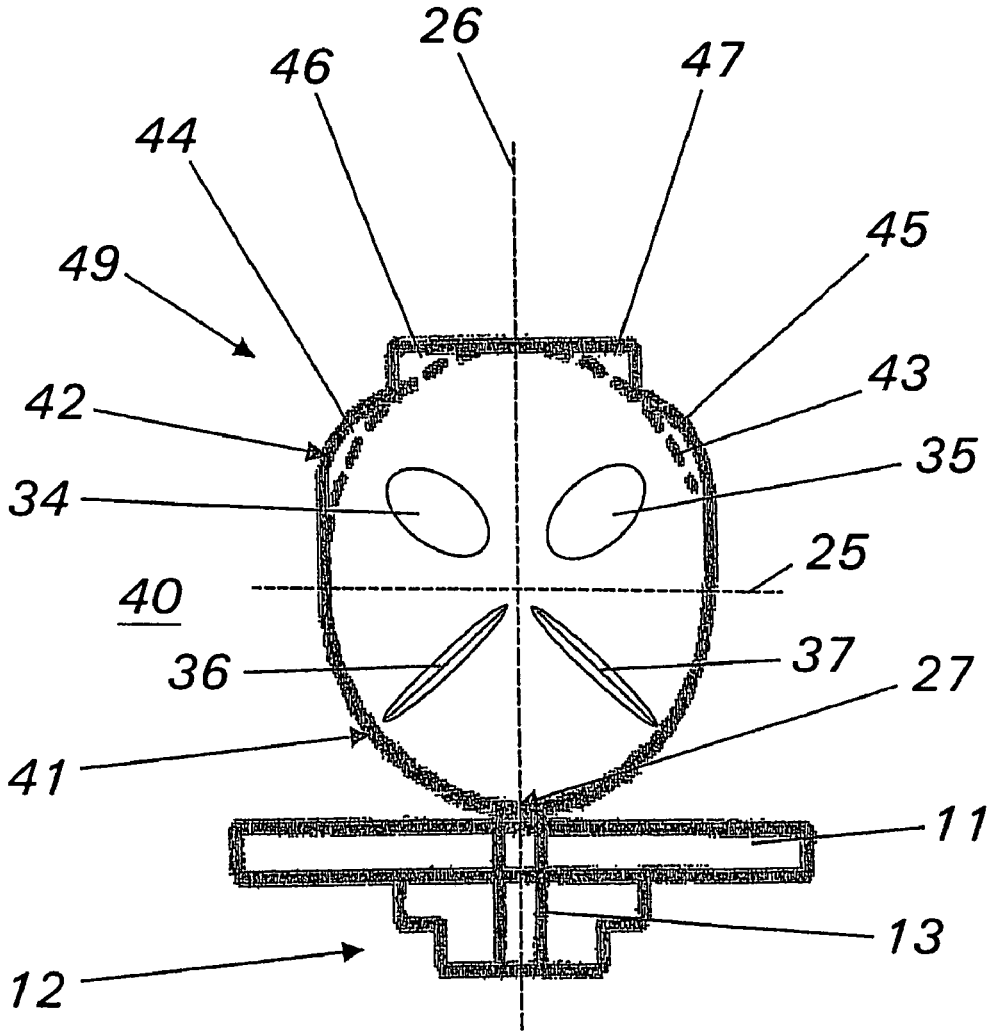
FIG. 4 is a front view of a fourth embodiment of an antenna according to the invention, in which the antenna element has a non-elliptical contour with a rectangular section and additional lobes above a separating plane.

In the embodiment shown in FIG. 4, the modified section 42 of the antenna element 49 of the broadband monopole antenna 40 with the right-angled corners 46, 47 and the lobes 44, 45 is similar to the modified section 16 shown in FIG. 2. Since the basic shape is a vertical elliptical disk 43, the section underneath the separating plane 25 is an elliptical section 41. A horizontal elliptical disk (with the major axis horizontal) can also be used, analogously, as the point of origin for the antenna element in the form of a disk.

If the area covered by the circular disk shown by dashed lines in FIGS. 1 to 3 is identical to the area of the antenna element shapes shown by solid lines, then the resonant frequencies are likewise virtually identical. The lower resonant frequency can then be determined approximately using the following relationships:

$$f = \frac{3.2}{a}\ \text{GHz}\,(a\ \text{in cm})$$

This equation is valid only when the conductive base surface 11 has a minimum diameter of one wavelength at the lowest operating frequency. If the base surface diameter is smaller than this size, then the lower operating frequency is shifted in the direction of higher frequencies. The size of the base surface also influences the vertical polar diagram, in particular at the upper end of the operating frequency band.

In the embodiments shown in FIGS. 1 to 3, the upper half of a circular disk has been modified. As can be seen from FIG. 4, these modifications may, of course, also be applied to a horizontal or vertical elliptical disk 43 whose major axis to minor axis ratio is approximately 1.1 to 1.3. Larger values of this ratio lead to a narrower bandwidth.

The material of the base surface 11 must be highly conductive, with aluminum or brass being used by preference. In order to avoid further losses, the thickness of the base surface material should be considerably greater than the penetration depth of the skin effect. The shape of the base surface 11 is in fact of secondary importance. It may be square, round or polygonal. Round shapes are preferable because they lead to round horizontal polar diagrams. The choice of materials and thicknesses for the antenna element 19, 29, 39, 49 in the form of a disk is subject to the same considerations as for the base surface 11.

The distance (h) that the antenna element 19, 29, 39, 49 is spaced above the base surface 11 is preferably in the range between 0.3 and 1 mm. The surface of the antenna element 19, 29, 39, 49 may also be deliberately interrupted by openings 34, 35 (FIG. 4). These openings 34, 35 may have round, elliptical, square or any desired polygonal shapes. The arrangement of these openings or apertures can be selected to allow improved antenna matching in specific frequency ranges of the operating band.

In the embodiments described above, the monopole or antenna element 19, 29, 39, 49 is fed via a coaxial connector 12, which is a frequently used type of feed. However, the monopole may also be driven via a separate feed network, which is arranged on the upper or lower face of the base surface 11. The feed network which, for example, may also include filter structures or active elements, connects the external interface (preferably a coaxial connector) to the monopole.

Figure 5:
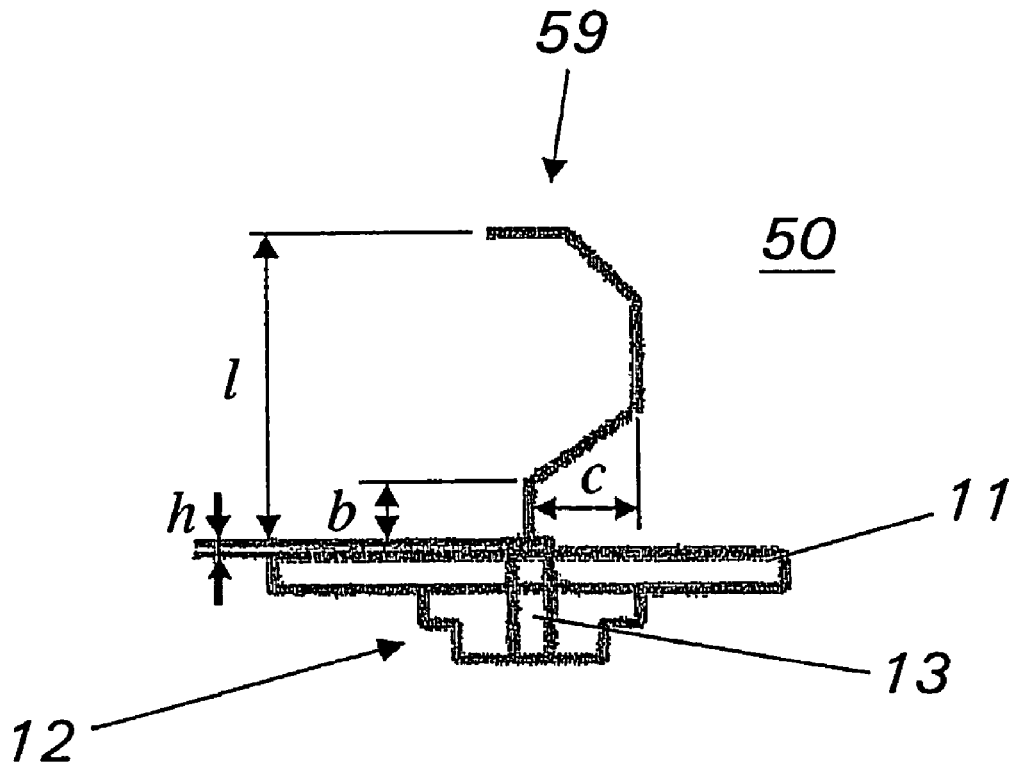
FIG. 5 is a side view of another embodiment of an antenna according to the invention, which is curved with straight sections in places, in order to reduce the physical height.
Figure 6:
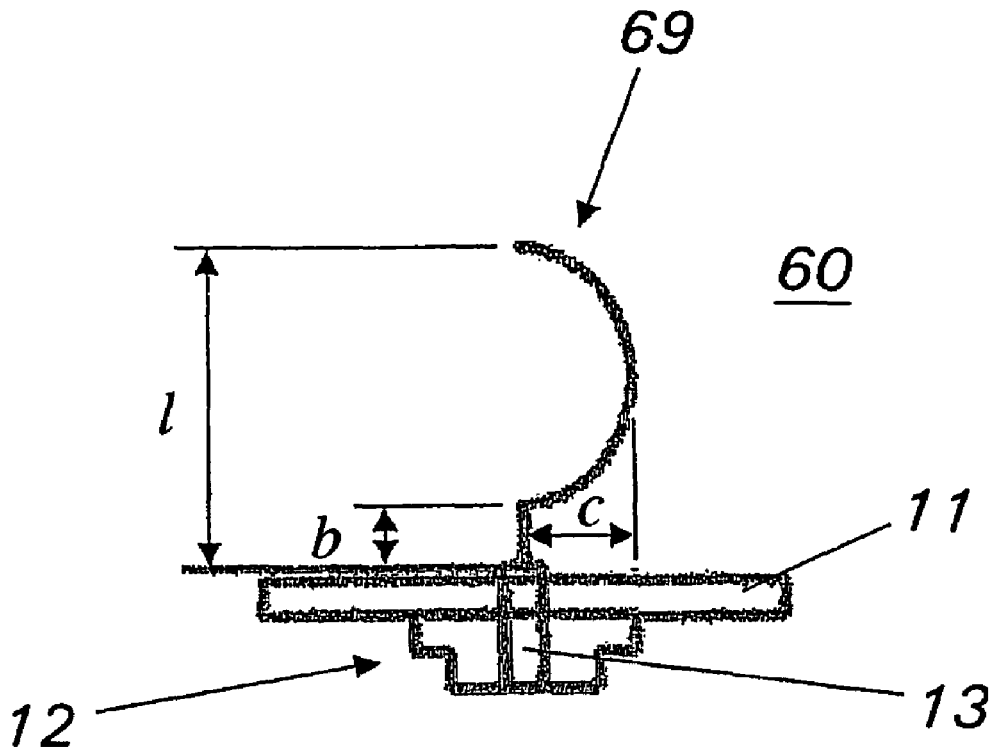
FIG. 6 is a side view of another embodiment of a curved antenna with continuous curvature on one side.
Figure 7:
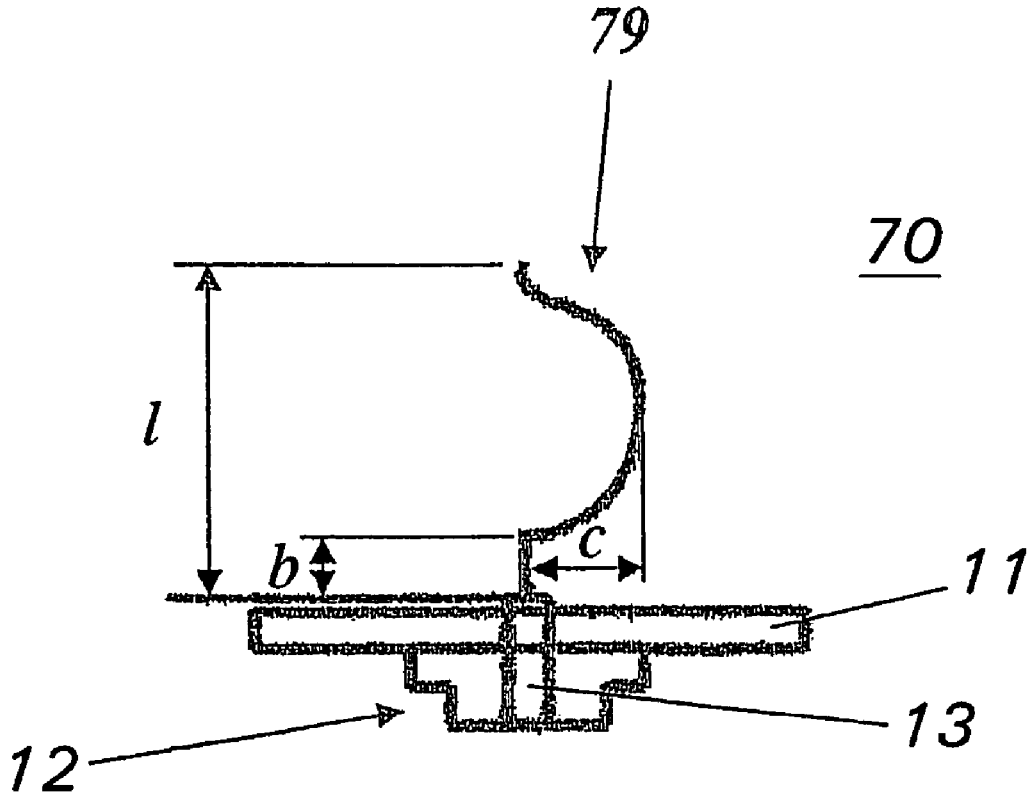
FIG. 7 is a side view of another embodiment of a curved antenna with continuous curvature in the opposite direction.

The physical height of the disk antenna from the above-mentioned Agrawall article is about 62.5% of the wavelength of the lower operating frequency (f=3.75 GHz) for a VSWR of <1.5. This will correspond to a physical height of 234 mm with the scale converted to the present example of a lower operating frequency of 800 MHz. This physical height is not acceptable for antennas within buildings (in-house areas). The physical height must therefore be considerably reduced for a field of use such as this. This reduction in the physical height is achieved in the present invention by additionally curving the previously planar surface of the antenna element (monopole) 19, 29, 39, 49 which is in the form of a disk. FIGS. 5 to 7 show side views of embodiments of antenna elements curved in this way.

FIG. 5 shows a first embodiment of a broadband monopole antenna 50 with a curved antenna element 59 in the form of a disk. The curved antenna element 59 in the form of a disk has a vertical length l. The curvature of the antenna element 59 in the form of a disk starts above a predetermined distance b from the lower edge of the antenna element 59. The curvature of the antenna element 59 in the form of a disk results in the antenna element 59 having a depth c. The curvature of the antenna element 59 in FIG. 5 is not continuous, but is composed of pieces of straight sections. The antenna element 69 of the broadband monopole antenna 60 shown in FIG. 6 in contrast has continuous curvature in one direction. The antenna element 79 of the broadband monopole antenna 70 shown in FIG. 7, finally, has continuous curvature in two directions.

The shapes illustrated in FIGS. 5 to 7 are only preferred examples. The primary important factor is that the surfaces are curved. The actual shape of the curvature is in fact of secondary importance. The antenna element surface may also be curved on a plane at right angles to the plane of the paper, in addition to the curvature illustrated in FIGS. 5 to 7. Furthermore, beads 36, 37 (FIG. 4) may also be incorporated (formed) in the surfaces of the antenna elements 19, . . . 79. These beads 36, 37 can increase the mechanical robustness of the antenna element, particularly when the strength of the surface is weakened by openings 34, 35. The size and distribution of the openings 34, 35 and beads 36, 37 may be matched to the respective conditions, within wide limits. FIG. 4 shows only one example relating to this.

For a bandwidth ratio of approximately 1:8 with a VSWR of <1.5, it is advantageous to comply with the following dimensions as shown in FIGS. 5 to 7:

$$l=0.2-0.35\lambda$$

$$b=0.02-0.06\lambda$$

$$c=0.07-0.13\lambda$$

where λ denotes the wavelength of the lowest operating frequency, and discrepancies from these values restrict the bandwidth of the antenna.

EXAMPLE

An antenna which covers the frequency range from 800 to 6000 MHz with a VSWR of <1.5 has the following dimensions:

l=95 mm
b=16 mm
c=35 mm
h=0.5 mm
a=50 mm.

The shape shown in FIG. 2 with the curvature shown in FIG. 6 is chosen as the antenna element shape. The base surface 11 is round, and has a diameter of 200 mm.

LIST OF REFERENCE SYMBOLS

| | |
|---|---|
| 10, 20, . . . , 70 | Broadband monopole antenna |
| 11 | Base surface |
| 12 | Coaxial connector |
| 13 | Central conductor |
| 14 | Circular disk |
| 15 | Circle section |
| 16 | Modified section |
| 17, 18 | Corner (right-angle) |
| 19, 29, . . . , 79 | Antenna element (in the form of a disk) |
| 21, 22 | Lobe |
| 23, 24 | Corner (right-angle) |
| 25 | Separating plane |
| 26 | Center plane |
| 27 | Feedpoint |
| 31, 32 | Corner (acute angle) |
| 33 | Corner |
| 34, 35 | Opening |
| 36, 37 | Bead |
| 41 | Ellipse section |
| 42 | Modified section |
| 43 | Elliptical disk |
| 44, 45 | Lobe |
| 46, 47 | Corner (right-angle) |
| a | Radius (circular disk) |
| h | Height |
| l | Length (antenna element) |
| b | Distance |
| c | Depth |

We claim:

1. A broadband monopole antenna comprising:

a planar, electrically conductive base surface; and an antenna element arranged vertically above said base surface, said antenna being spaced from said base surface by a distance (h), wherein said antenna element is in the form of a disk having a modified section starting from a shape of one of a circular disk and an elliptical disk, said modified section comprising a rectangular edge contour and additional edge contours which have a shape other than circular or elliptical.

2. The broadband monopole antenna as claimed in claim 1, wherein said additional edge contours are in the form of round lobes.

3. A broadband monopole antenna comprising:

a planar, electrically conductive base surface; and an antenna element arranged vertically above said base surface, said antenna being spaced from said base surface by a distance (h), wherein said antenna element is in the form of a disk having a modified section starting from a shape of one of a circular disk and an elliptical disk, said modified section being bounded by a polygonal edge contour with corners which are of a shape other than rectangular.

4. The broadband monopole antenna as claimed in claim 3, wherein said polygonal edge contour has acute-angle corners and obtuse-angle corners.

5. A broadband monopole antenna comprising:

a planar, electrically conductive base surface;

an antenna clement arranged vertically above said base surface, said antenna being spaced from said base surface by a distance (h) and having a mirror-image symmetry with respect to a center plane, which is vertical to said base surface; and a feed point for feeding in an antenna signal, said feed point located on said center plane on an edge of said antenna element that faces said base surface, said antenna signal being provided via a feed network arranged on one side of said base surface, said feed network having at least one of (i) filter structures and (ii) active elements, wherein said antenna element is in the form of a disk having a modified section starting from a shape of one of a circular disk and an elliptical disk, said modified section being bounded an edge contour that is other than circular or elliptical in shape.

6. A broadband monopole antenna comprising:

a planar, electrically conductive base surface; and an antenna element arranged vertically above said base surface, said antenna being spaced from said base surface by a distance (h) and being curved in order to reduce the overall height of the antenna, in such a way that a vertical length of said antenna is less than in an uncurved state, wherein said antenna element is in the form of a disk having a modified section starting from a shape of one of a circular disk and an elliptical disk, said modified section being bounded by an edge contour that is other than circular or elliptical in shape.

7. The broadband monopole antenna as claimed in claim 6, wherein said vertical length is in the range between 0.2 and 0.35 λ, where λ denotes the wavelength of the lowest operating frequency of said antenna.

8. The broadband monopole antenna as claimed in claim 6, wherein the curvature of said antenna element starts above a predetermined distance from a lower edge of said antenna element, said predetermined distance being in the range between 0.02 and 0.06 λ, where λ denotes the wavelength of the lowest operating frequency of said antenna.

9. The broadband monopole antenna as claimed in claim 6, wherein the curvature of said antenna element results in the antenna element having a depth which is in the range between 0.07 and 0.13 λ, where λ denotes the wavelength of the lowest operating frequency of said antenna.

10. A broadband monopole antenna comprising:

a planar, electrically conductive base surface;

an antenna element arranged vertically above said base surface and being spaced from said base surface by a distance (h); and openings in said antenna element, said openings improving the matching of said antenna in specific frequency ranges of an operating band, wherein said antenna element is in the form of a disk having a modified section starting from a shape of one of a circular disk and an elliptical disk, said modified section being bounded by an edge contour that is other than circular or elliptical in shape.

11. A broadband monopole antenna, comprising:

a planar, electrically conductive base surface;

an antenna element arranged vertically above said base surface, said antenna being spaced from said base surface by a distance (h); and beads formed in the surfaces of said antenna element, said beads increasing the mechanical robustness of said antenna element, wherein said antenna element is in the form of a disk having a modified section starting from a shape of one of a circular disk and an elliptical disk, said modified section being bounded by an edge contour that is other than circular or elliptical in shape.

* * * * *